US009108097B1

(12) United States Patent
Rhone

(10) Patent No.: US 9,108,097 B1
(45) Date of Patent: Aug. 18, 2015

(54) DEVICE FOR GOLF PRACTICE PUTTING AND TARGET IMAGER

(71) Applicant: Eric C. Rhone, St. Louis, MO (US)

(72) Inventor: Eric C. Rhone, St. Louis, MO (US)

( * ) Notice: Subject to any disclaimer, the term of this patent is extended or adjusted under 35 U.S.C. 154(b) by 14 days.

(21) Appl. No.: 13/999,409

(22) Filed: Feb. 24, 2014

(51) Int. Cl.
*A63B 69/36* (2006.01)
*A63B 71/06* (2006.01)
*A63B 57/00* (2015.01)

(52) U.S. Cl.
CPC ..... *A63B 69/3676* (2013.01); *A63B 57/0056* (2013.01); *A63B 2069/3602* (2013.01); *A63B 2071/0694* (2013.01)

(58) Field of Classification Search
CPC ..... A63B 57/0056; A63B 69/3676; A63B 69/3679; A63B 69/3661; A63B 2207/02; A63B 67/02; A63B 2207/00
USPC ..... 473/151, 153, 154, 157–159, 162, 171, 473/172–192, 194–196
See application file for complete search history.

(56) References Cited

U.S. PATENT DOCUMENTS

| | | | | | |
|---|---|---|---|---|---|
| 2,263,727 | A | * | 11/1941 | Gensburg | 273/118 A |
| 4,560,167 | A | * | 12/1985 | Perreau et al. | 473/180 |
| 4,906,006 | A | * | 3/1990 | Sigunick | 473/185 |
| 4,936,583 | A | * | 6/1990 | Peabody et al. | 473/185 |
| 5,181,721 | A | * | 1/1993 | Halliburton | 473/189 |
| 5,265,875 | A | * | 11/1993 | Fitzgerald | 473/169 |
| 5,421,578 | A | * | 6/1995 | Ames | 473/159 |
| 5,445,373 | A | * | 8/1995 | Franks | 473/409 |
| 5,452,897 | A | * | 9/1995 | Mick | 473/409 |
| 5,527,041 | A | * | 6/1996 | Terry et al. | 473/150 |
| 6,004,220 | A | * | 12/1999 | Razzano | 473/200 |
| 6,036,608 | A | * | 3/2000 | Morris | 473/220 |
| 6,099,139 | A | * | 8/2000 | Lapensee | 362/153.1 |
| 6,129,641 | A | * | 10/2000 | Burch | 473/404 |
| 6,146,283 | A | * | 11/2000 | Ferguson, III | 473/145 |
| 6,165,083 | A | * | 12/2000 | Stenger et al. | 473/404 |
| 6,213,887 | B1 | * | 4/2001 | Carney | 473/183 |
| 6,241,621 | B1 | * | 6/2001 | Maher | 473/185 |
| D448,059 | S | * | 9/2001 | Battaglia | D21/791 |
| 6,419,590 | B1 | * | 7/2002 | Criger | 473/174 |
| 6,503,152 | B1 | * | 1/2003 | Pelz | 473/257 |
| 6,569,028 | B1 | * | 5/2003 | Nichols et al. | 473/192 |
| 6,579,191 | B1 | * | 6/2003 | Hambly | 473/151 |
| 6,695,709 | B1 | * | 2/2004 | Ottensmeyer | 473/258 |
| 6,767,291 | B1 | * | 7/2004 | McCarthy | 473/220 |
| 6,796,910 | B1 | * | 9/2004 | Foster | 473/220 |
| 6,871,414 | B2 | * | 3/2005 | Burney et al. | 33/508 |

(Continued)

OTHER PUBLICATIONS page 44 Schafter Kirchhoff Laser Pattern Generators on company website(copy enclosed).

(Continued)

*Primary Examiner* — Mark Graham
(74) *Attorney, Agent, or Firm* — Veo Peoples, Jr.

(57) ABSTRACT

A method and device for training and practice putting is disclosed, comprising optical beams generated vertically onto the surface of a practice putting green having a practice putting cup disposed in an uneven terrain, said beams being patterned in the image of a plurality of concentric circles of light surrounding a center formed by the circumference of said golf cup. The intensity of the illumination of the light along the circumference of each of the concentric rings varies in accordance with the terrain of the practice green in order to train the practice putter to identify subtle elevational changes, curves and slopes of the green and how those factors influence the speed at which to putt a golf ball into the cup.

13 Claims, 7 Drawing Sheets

(56) References Cited

U.S. PATENT DOCUMENTS

| | | | | |
|---|---|---|---|---|
| 7,134,966 | B1 * | 11/2006 | Tice | 473/220 |
| 7,297,069 | B2 * | 11/2007 | Donovan et al. | 473/173 |
| 7,306,525 | B2 * | 12/2007 | Sawada | 473/212 |
| 8,109,837 | B1 * | 2/2012 | Khananayev et al. | 473/221 |
| 8,142,301 | B2 * | 3/2012 | Haag et al. | 473/222 |
| 8,376,871 | B1 * | 2/2013 | Cloud | 473/163 |
| 8,398,500 | B1 * | 3/2013 | Bouvier | 473/192 |
| 8,439,767 | B2 * | 5/2013 | Feiner | 473/261 |
| 8,499,465 | B2 * | 8/2013 | Kuta | 33/289 |
| 8,753,218 | B2 * | 6/2014 | Suchanek | 473/176 |
| 8,864,333 | B2 * | 10/2014 | Burkart et al. | 362/234 |
| 2009/0203457 | A1 * | 8/2009 | Gibbons | 473/152 |
| 2010/0004068 | A1 * | 1/2010 | Adame | 473/176 |
| 2010/0197420 | A1 * | 8/2010 | Lim | 473/176 |
| 2014/0342842 | A1 * | 11/2014 | Allen et al. | 473/151 |

OTHER PUBLICATIONS p. 44 Schatter Kirchhoff Laser Pattern Generators on company website(copy enclosed) Jan. 2014.

* cited by examiner

DEVICE FOR GOLF PRACTICE PUTTING AND TARGET IMAGER

FIELD OF THE INVENTION

This invention relates to training devices for improved golf putting. More particularly it relates to practice putting training devices that employ optical beams, particularly laser beams.

BACKGROUND OF THE PRIOR ART

The game of golf is very challenging but enjoyable by all, if the various skills required for the game can be mastered. One of the most difficult skills to master is that of putting the golf ball. It appears deceptively simple to the casual observer, but in learning the skills needed, more practice, and even more practice often fail to teach most how to come anywhere close to mastering the putting of a golf ball into the golf cup. The speed and the direction that the ball must possess when making a particular putt are each influenced by a variety of conditions of the green. Especially, the degree of slope or curve of the green's surface toward/away from the hole and elevation relative to the juxtaposition of the golf cup or hole effects the adjusted speed and direction to aim the putt, which in turn affects the shape or curve of the ball's route to the golf cup. All too often putts are not alignable by a straight line into the hole. Professional golfers can rely on caddies who nave read and recorded a particular green's slope from practically every direction and distance of approach. But for amateurs who often play without the assistance of a caddie, self training techniques and devices for learning how to read the putting surface of a green can be invaluable. An efficient and simple training device that would enable an average amateur golfer to more readily learn and practice subtle breaks, curves, slopes, and speeds from various distances on a golf green (using little more than visual observation) would represent a significant advancement in the art of golf training and would be well received by all those who endeavor to learn, to teach, and to manage putting in the game of golf on or off golf courses.

Using optical beams, especially lasers, as guiding systems for putting practice are well known in the art. Typically, laser guided golf putting systems use lasers to trace substantially horizontal, straight line paths for the golfer to aim along. They may use external lasers or in some instances lasers embedded within the shaft or head of the putter. Such systems are disclosed in, for example, U.S. Pat. Nos. 6,213,887B1; 5,818,036; 6,579,191; 6,213,887; 6,450,893; 6,695,709; 5,527,041; 6,036,608, and many more. However, as they use substantially horizontal directional beams, they all fail to effectively train putting skills for most putts which are neither flat nor straight line putts. Learning speed control for these curvy breaks is practically impossible. Training to adjust the rolling speeds of putted golf balls to accommodate elevational breaks and slopes or curves of golf greens, without the aid of a caddie, have therefore led to extremely complex methods and devices, as for example those disclosed in U.S. Pat. No. 7,028,032 which uses platforms, reference numerals, aim points, etc. A means for employing laser technology to replace and/or negate the need for such complex platforms, etc. in prior art devices would constitute a welcomed advancement in the art of golf putting training.

SUMMARY OF THE INVENTION

The invention is a training device and method for practicing the subtleties of putting on golf greens where there exist elevational breaks, curves, and/or slopes that influence the speed and directional route of the putted ball to successfully drop into the golf cup.

The invention comprises at least two, and preferably three principal components. First, there is a source for directing an optical beam, particularly a laser onto the surface of a practice green, said source being engageable to a practice putting flagstick and said source, upon engagement with said flagstick, being vertically disposed to in turn deliver the beam in a vertical direction. The source can also be a source for other optical beams, including but not limited to L.E.D., incandescent light, and infrared. The optical beam may be white light, diffracted light, filtered into a single color. For example, most commonly colored lasers are suitable in either red or green. It is preferred to use colored optical beams because subtle changes in the intensity of the beam, a valuable attribute of the invention, are more readily detected by the naked eye, during the day, in the evening, or when there is less tan an ideal amount of daylight.

Secondly, the optical beam source is employed in combination with a component for generating a pattern similar to a target or even a bullseye. That is, a pattern of concentric circles of light surrounding a central point, said central point being the perimeter of a golf cup. The golf cup is disposed in the surface of a golf green, particularly a practice putting green. The green can be either a real ground or fabricated to simulate a real golf green. Such fabrications may be found indoors or out doors, and can be constituted from mats, rugs, tarps, etc. The pattern of the invention has a plurality of at least 2 concentric illuminated circles of light.

Thirdly, the invention preferably employs a micro controller for communicating digitized electronic signals between the light source and each point along the circumferential perimeter of each concentric circle of light along the surface of the practice green, and serves to translate subtle elevational, directional curves and slopes at the greens surface by varying the intensity of the light beam at each point along the circumference of each concentric circle of the optical beam imaged at the surface of the green.

DETAILED DESCRIPTION AND OPERATION OF THE PREFERRED EMBODIMENTS

Figure 9:
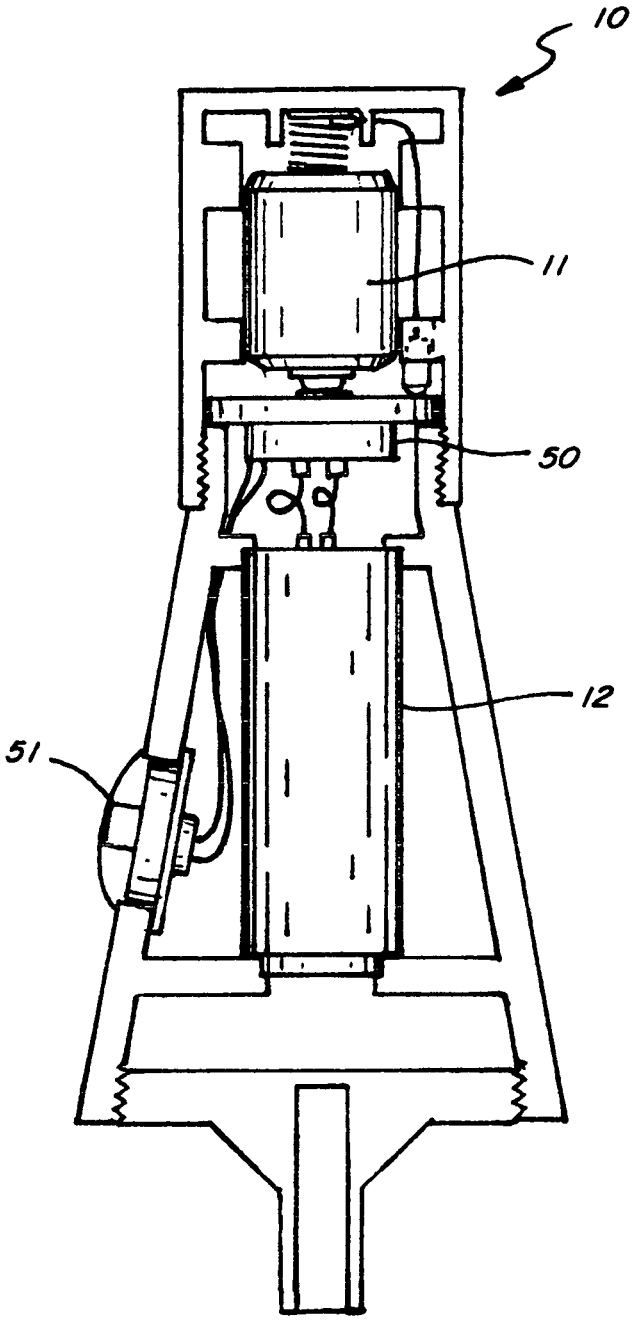
FIG. 9 is a cross-sectional side view along 9-9 of FIG. 8 depicting an example of the internal components of the flagstick-combined embodiment of the device of the present invention.

Preferably, the device 10 of the invention is laser generated, and the method of this invention preferably employs laser generated light. Referring now to FIGS. 1-4 for the portable handheld embodiment and FIGS. 5-9 for the flagstick-combined device of the invention, the device 10 of the invention comprises preferably a source 11 for vertically directing optical beam or beams 13. The source 11 may be for example a potentiometer. The source is employed in combination with a diffractive beam shaping component or element 12 integrally attached thereto to surround a practice putting flagstick 15. Such combinations have been known to exist but not for generating a plurality of concentric illuminated circles 14, nor employed in a vertically directed golf putting device or method, nor attachable surrounding a practice putting flagstick. The beam shaping component 12 of the present invention, on the other hand, vertically projects beams that pattern a plurality of at least 2 concentric illuminated circles 14 surrounding a center point, said center point being defined by a golf cup 18. The combination comprising the device 10, of the present invention is preferably engageable at the distal end 16 of a practice putting flagstick 15, said flagstick 15 having an opposite end 17 which is insertable into a golf cup 18. The golf cup 18 is the type disposed in a substantially planar practice golf green 60 (shown in FIG. 5). Preferably a controller 50 (shown more clearly in FIG. 9) receives signals from the laser(s) and correlates the distance traveled by the laser light beam 13 between its source and the point at which beams 13 contact the surface of the green 60 and thus vary the intensity and/or shading of color of beam(s) 13. Optionally, an on/off switch 51 may be installed. Accordingly, each point along concentric circles 14 will vary in intensity of color and/or illumination corresponding to its distance or juxtaposition from the source 11. This allows golfer 20 to gauge putts by sighting the elevation, contour, and slope of the green 60 near golf cup 18 and to imagine and train himself visually how such factors influence the shape or curve of the line the putted ball 19 must travel in order to top into cup 18 (see FIG. 5).

Figure 1:
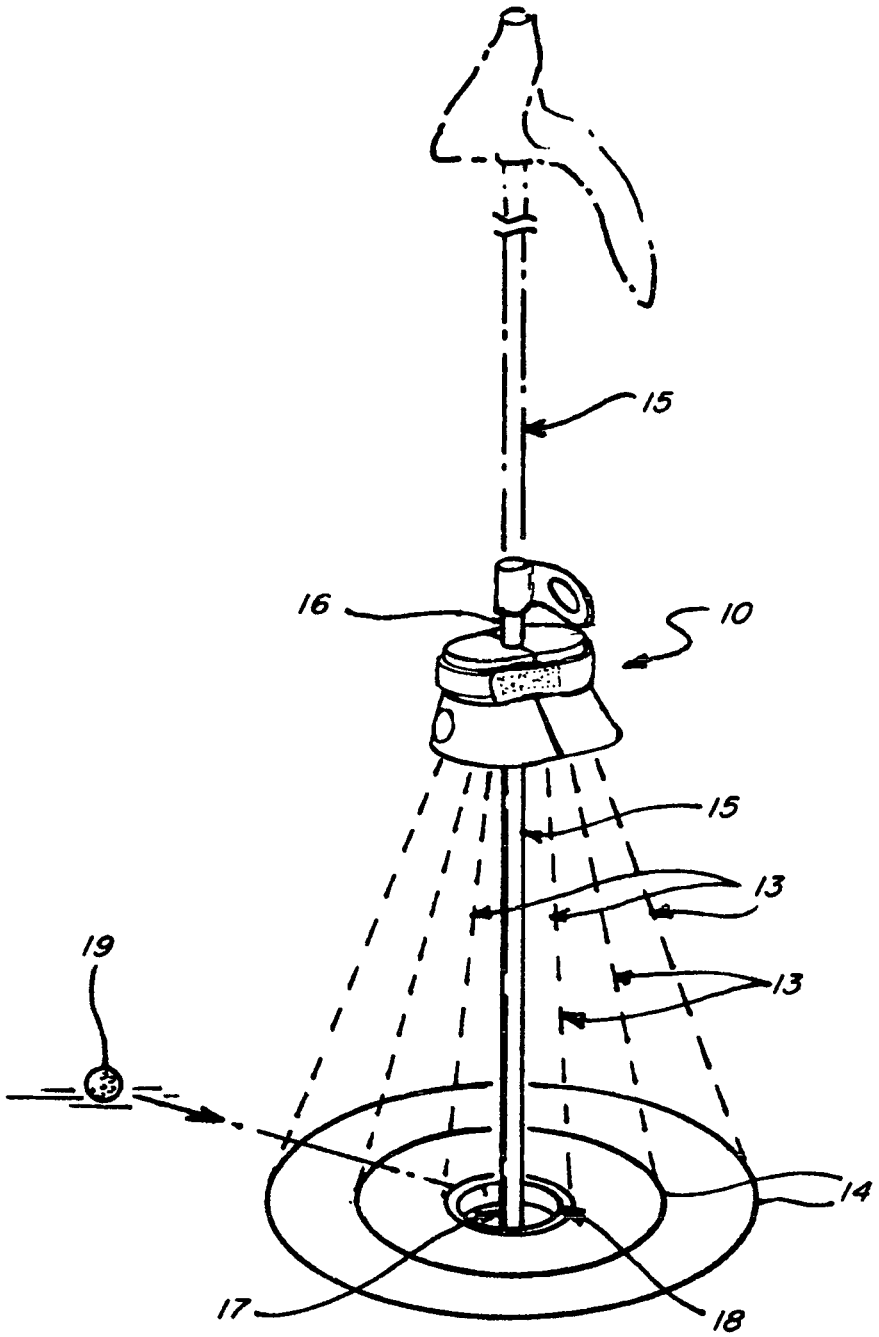
FIG. 1 is a perspective view of a portable handheld embodiment of the device of the present invention affixed to the top of a practice putting flagstick, which flagstick is disposed within a practice putting golf cup.
Figure 2:
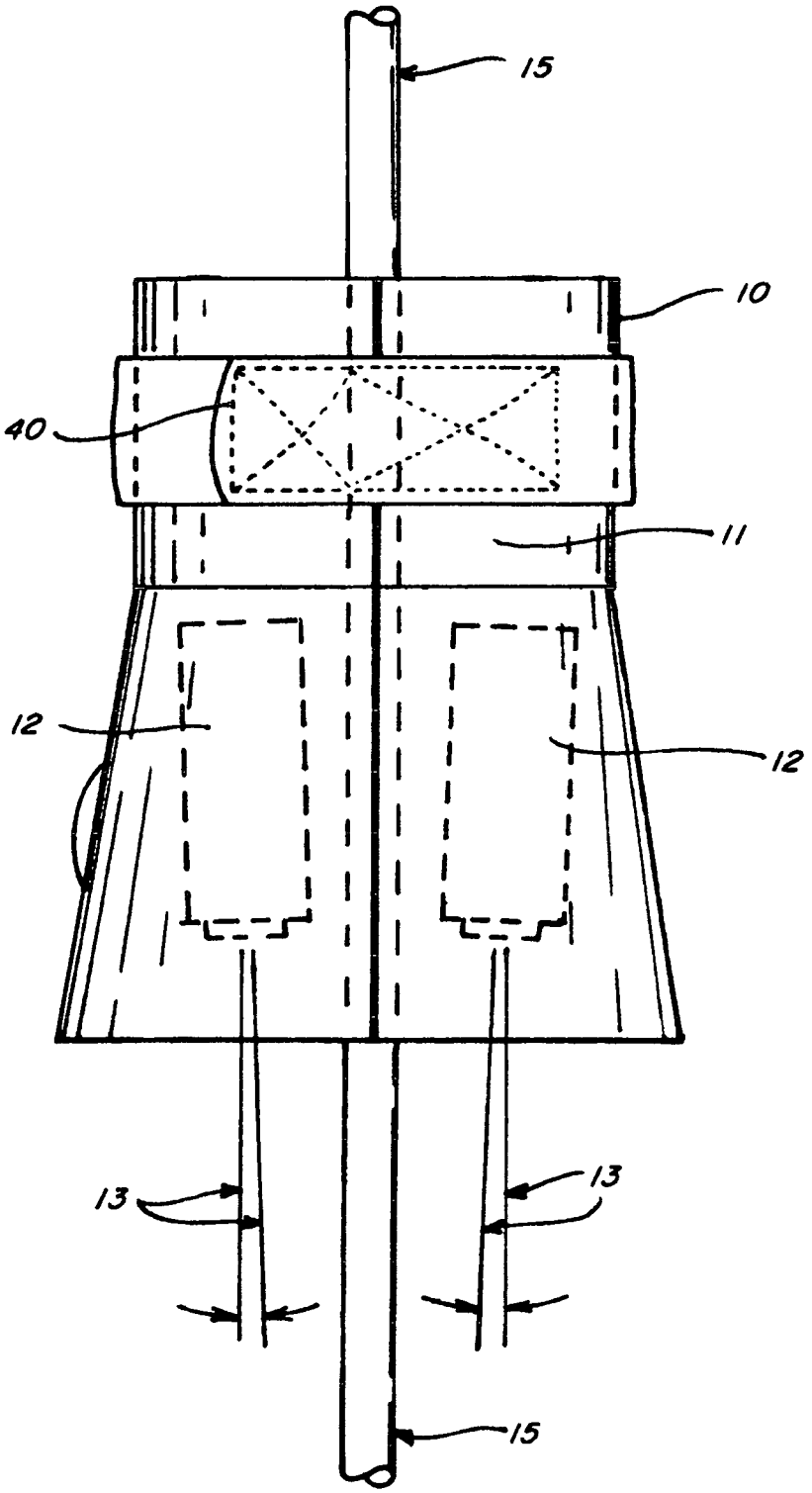
FIG. 2 is a frontal view a portable embodiment of the present invention attached to a flagstick.
Figure 3:
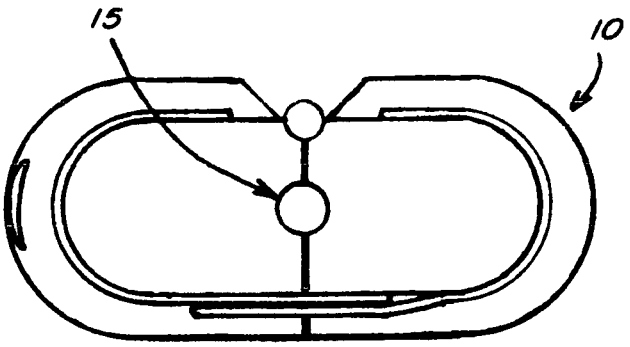
FIG. 3 is a top view of a portable embodiment of the present invention removably engaged to the practice putting flagstick.
Figure 4:
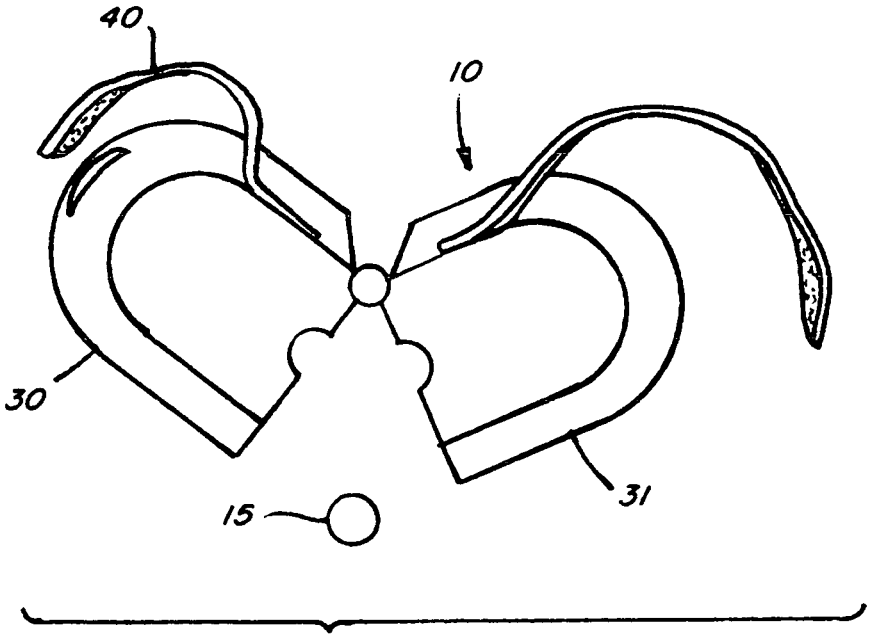
FIG. 4 is a top view of a portable embodiment disconnected from the flagstick.
Figure 5:
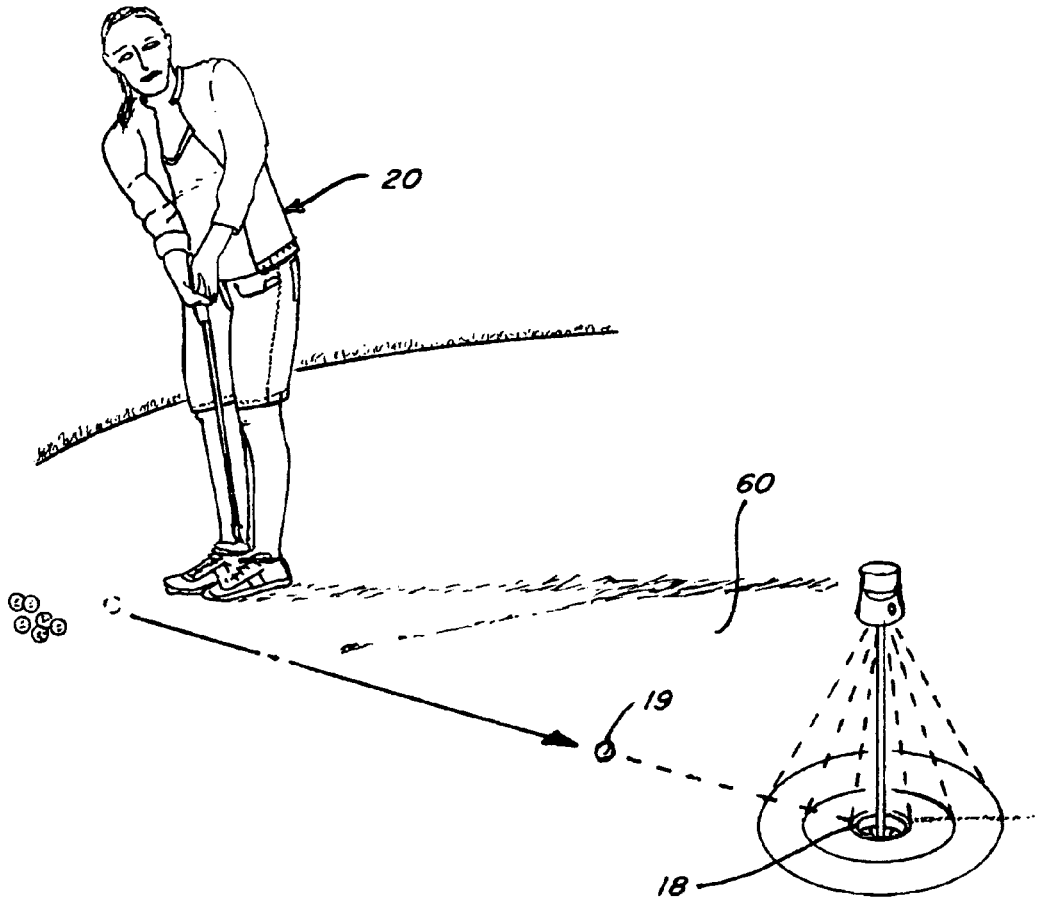
FIG. 5 is a perspective view of a flagstick-combined embodiment of the present invention disposed within a golf hole and an illustration of a player practicing putting at a golf cup within a hole on the surface of a practice green.
Figure 6:
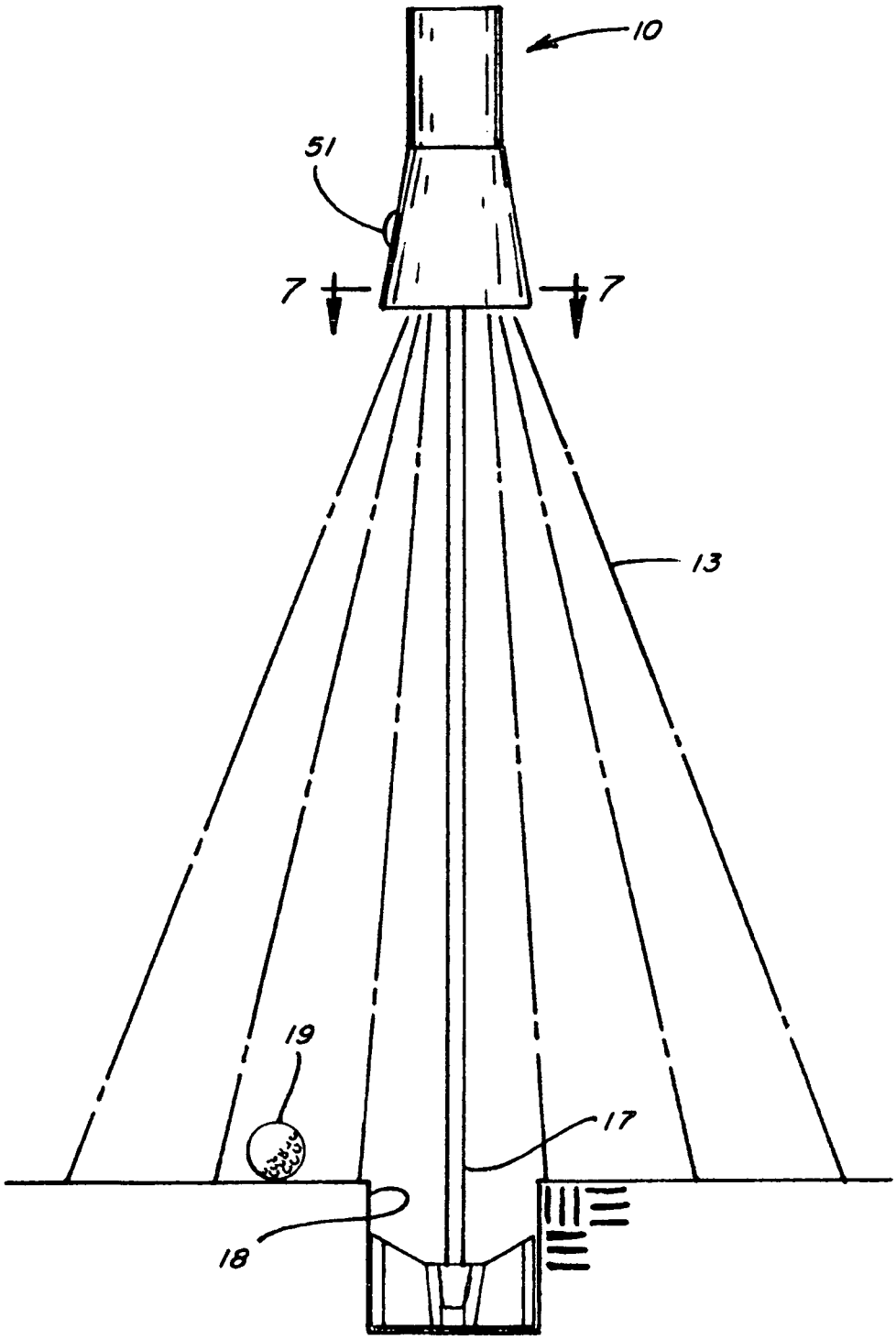
FIG. 6 is a front plan view of a stick-combined embodiment of the invention integrally combined with a flagstick.
Figure 8:
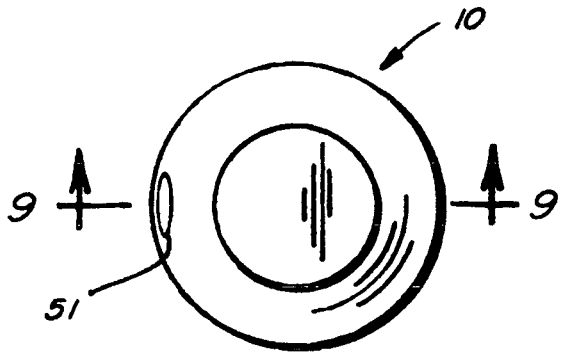
FIG. 8 is a top view of the flagstick-combined embodiment of the present invention.
Figure 7:
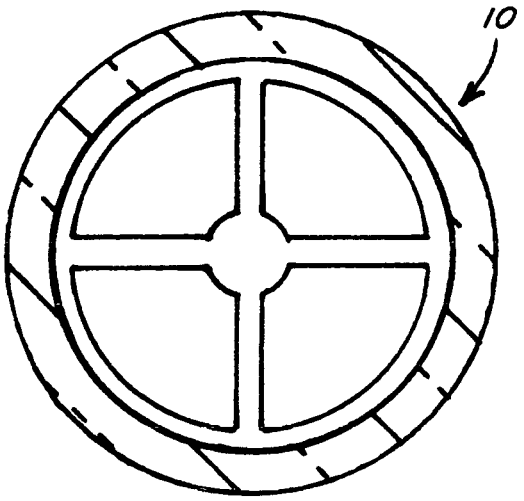
FIG. 7 is a bottom cross-sectional view of the flagstick-combined embodiment of the present invention along 7-7 of FIG. 6.

An alternative preferred embodiment of the present invention is to provide a portable handheld version of the device 10 of the present invention which, as depicted in FIG. 4 is hinged to open into two halves 30 and 31 in clam shell fashion and said halves being able to close securely onto or to be removed easily from around a flagstick 15. The device 10 surrounds said flagstick 15. It can be held in place by for example a fastener 40 which can be as simple as velcro straps or more sophisticated fasteners, of well know variety, may be employed.

Another preferred embodiment for certain customers comprises device 10 being provided in unitary integral construction with flagstick 15, as particularly noted in FIGS. 5 through 9. Golf courses or practice ranges may prefer employing this unitary construction.

It should be understood that the beams 13 and circles of the present invention may vary in color, and that the devices are preferably battery operated but may be powered by other sources. Also as previously stated other forms of light energy other than lasers may be adaptable for employment in the method and device of the present invention. Another alternative embodiment of this invention is to dispose the device 10 of the invention within a golf cup 18 so as to vertically direct the beams 13 upward onto a mirror (not shown) which can reflect the concentric circular light pattern 14 back downward onto green 60. It is to be understood that optical lens and cameras may be employed in the method and device of this invention.

In the method and operation of the present invention, preferably a laser generator configured to combine with or to be attachable to surround a flagstick, indisposed to vertically direct a laser pattern of concentric and illuminated circles onto the surface of a golf putting green. The concentric illuminated circles have at their center a golf cup disposed in said green. The illumination of the circles can preferably vary in intensity of light or shade of color in correlation to the contour of the green, i.e. elevation, curve, and/or slope, near the golf hole. In this method the laser generator may be integral to the flagstick or may be portable, i.e. easily attachable to or removable from the flagstick. Also this method may be employed to have the laser generator within a golf cup and engaging the flagstick at the end inside a golf cup so as to vertically generate the concentric illuminated circles upwardly onto for example a mirror which reflects the illuminated concentric circles of light back downward onto the green.

What is claimed is:

1. A training device for practice putting, comprising; a.) a source for vertically directing an optical beam, said source being in combination with a diffractive beam shaping component for patterning concentric circles of light about a central spot, said spot being defined by the circumference of a golf cup disposed upon a substantially planar practice putting green and, b.) said combination being engageable at the distal end of a practice putting flagstick to surround said flagstick having a distal end and an opposite end, said opposite end being insertable into the center of said golf cup; whereby said concentric circles of light representing a plurality of at least 2 circles radiating annularly outward from said golf cup; thereby serving to train golfers in directional putting accuracy and proper putting speed.

2. The device of claim 1, having a controller integral to said beam source to digitally translate and correlate variations in the visual intensity of said optical beam along each point of each circle's circumference in proportion to that point's distance and juxtaposition from the source.

3. The device of claim 1 being integral to the golf flagstick in unitary fashion.

4. The device of claim 1 being portable.

5. The device of claim 1 wherein said beam source is a laser generator.

6. The device of claim 1 or 2 having a color other than white, and the intensity of said color at each point along each circle's perimeter corresponding to its distance from the source.

7. The device of claim 1 being battery powered.

8. The device of claim 1 including a pattern imager having an optical lens.

9. The device of claim 1 having its source include a camera.

10. The device of claim 1 having its source to be an LED light source.

11. The device of claim 1 being a laser generator.

12. The device of claim 1 wherein the light source is directed upwardly from within the golf cup and reflected back downward onto the practice green surface.

13. The device of claim 1 wherein a clam shell type design is employed to provide said device in two halves attachable to surround the flagstick.

* * * * *